US005712074A

United States Patent [19]

Sato et al.

[11] Patent Number: 5,712,074

[45] Date of Patent: Jan. 27, 1998

[54] TONER FOR DEVELOPING ELECTROSTATIC LATENT IMAGE

[75] Inventors: Yukiya Sato; Masayuki Maruta; Yasushi Ito; Genichi Nakamura, all of Wakayama, Japan

[73] Assignee: Kao Corporation, Tokyo, Japan

[21] Appl. No.: 779,664

[22] Filed: Jan. 7, 1997

[30] Foreign Application Priority Data

Jan. 9, 1996 [JP] Japan ..... 8-019423

[51] Int. Cl.[6] ..... G03G 9/087; G03G 9/097

[52] U.S. Cl. ..... 430/110; 430/109; 430/904

[58] Field of Search ..... 430/110, 109, 430/904

[56] References Cited

U.S. PATENT DOCUMENTS

| | | | |
|---|---|---|---|
| 4,820,604 | 4/1989 | Manca et al. | 430/110 |
| 4,868,084 | 9/1989 | Uchide et al. | 430/110 |
| 5,035,748 | 7/1991 | Burow et al. . | |

FOREIGN PATENT DOCUMENTS

| | | |
|---|---|---|
| 0413604 | 2/1991 | European Pat. Off. . |
| 54-54039 | 4/1979 | Japan . |
| 58-057102 | 12/1983 | Japan . |
| 59-197048 | 11/1984 | Japan . |
| 60-184259 | 9/1985 | Japan . |
| 62-150260 | 7/1987 | Japan . |
| 62-150261 | 7/1987 | Japan . |
| 2-003073 | 1/1990 | Japan . |
| 41-84356 | 7/1992 | Japan . |
| 62-95104 | 10/1994 | Japan . |
| 7-278310 | 10/1995 | Japan . |
| 2263555 | 7/1993 | United Kingdom . |

*Primary Examiner*—Christopher D. Rodee

*Attorney, Agent, or Firm*—Birch, Stewart, Kolasch & Birch, LLP

[57] ABSTRACT

A toner for developing an electrostatic latent image including a binder resin, a colorant, and a modified polysiloxane having the general formula (1):

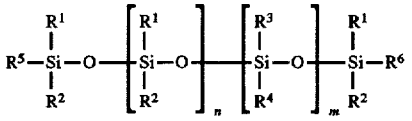

(1)

In the above general formula, $R^1$ to $R^4$, which may be identical or different, each stands for an alkyl group having 1 to 6 carbon atoms, a phenyl group, or a naphthyl group; $R^5$ and $R^6$, which may be identical or different, each stands for a linear or branched, saturated hydrocarbon group having an average number of carbon atoms of from 16 to 600; and n and m each stands for a number of zero (0) or more.

9 Claims, No Drawings

TONER FOR DEVELOPING ELECTROSTATIC LATENT IMAGE

BACKGROUND OF THE INVENTION

1. Field of the Invention

The present invention relates to a toner for developing an electrostatic latent image which is formed in electrophotography, electrostatic printing, or electrostatic recording. More specifically, the present invention relates to a toner for developing an electrostatic latent image having not only good fixing ability and releasing ability but also good blocking resistance and free flowability.

2. Discussion of the Related Art

In the fixing process in the method of forming fixed images by, for instance, electrophotography, from the viewpoint of having remarkably good thermal efficiency by the pressure-contact of a heat roller surface and an image-bearing surface of the sheet to be fixed, the heat-and-pressure fixing method using a heat roller is widely used in various high-speed copy machines and low-speed copy machines. However, when the surface of a heat roller contacts the surface of the visible image, the toner is likely to cause a so-called "offset phenomenon," wherein the toner is adhered to the surface of the heat roller, and thus transferred to a subsequent transfer paper.

In order to prevent this phenomenon, the surface of a heat roller is coated with a material having excellent releasing ability for the toner, such as fluororesins. Alternatively, a releasing agent, such as a silicone oil, is applied to the surface of a heat roller. However, the method of applying a silicone oil, etc. is likely to disadvantageously make the overall fixing apparatus large, thereby increasing its costs and also making it complicated, to bring about various device troubles.

Meanwhile, since the lowest fixing temperature of a toner is generally between the temperature of low-temperature offsetting of the toner and the temperature of the high-temperature offsetting thereof, the serviceable temperature range of the toner is from the lowest fixing temperature to the temperature for high-temperature offsetting. Accordingly, by lowering the lowest fixing temperature as much as possible and raising the temperature at which high-temperature offsetting occurs as much as possible, the serviceable fixing temperature can be lowered and the serviceable temperature range can be widened, which enables energy saving, high-speed fixing and prevention of curling of paper.

As for techniques for improving the offset resistance, toners containing silicone oils are disclosed in Japanese Patent Laid-Open Nos. 54-54039, 59-197048, and 2-3073, of which the disclosures are incorporated herein by reference. However, in these methods, when the amount of the silicone oils added is too large, the silicone oil exudes to the toner surface with the passage of time, so that the free flowability of the resulting toner is lowered, thereby causing blocking in the toner. On the other hand, when the amount of the silicone oil is too small, the offset resistance of the resulting toner is lowered.

Also, encapsulated toners containing silicone oils are disclosed in Japanese Patent Examined Publication No. 58-57102 and Japanese Patent Laid-Open Nos. 60-184259, 62-150260, and 62-150261, of which the disclosures are incorporated herein by reference. However, in cases where the encapsulated toners containing silicone oils are used as disclosed in these publications, the silicone oil having a low molecular weight evaporates upon applying heat by a heat roller, so that the triboelectric charger is spotted, thereby causing unevenness in triboelectric charging, which in turn leads to decreased image density and unevenness in density. Also, there arise problems in the blocking resistance and the free flowability of the toner.

Further, Japanese Patent Laid-Open Nos. 4-184356 and 6-295104 disclose toners containing silicone resins with an intention to solve the problems mentioned above. When using the toners containing silicone resins as disclosed in these publications, although the free flowability and the chargeability of the resulting toner are somewhat improved, the offset resistance and the low-temperature fixing strength are unsatisfactory because the silicone resins do not melt in the fixing temperature range.

In view of the above problems, an object of the present invention is to provide a toner for developing an electrostatic latent image having not only excellent offset resistance and releasing ability upon heat-roller fixing, but also having excellent blocking resistance and free flowability as well as good low-temperature fixing ability.

These and other objects of the present invention will be apparent from the following description.

SUMMARY OF THE INVENTION

As a result of intensive research in view of the above problems, the present inventors have found that a toner having excellent offset resistance, releasing ability, and scratching inhibition without impairing its blocking resistance and free flowability as well as good low-temperature fixing ability can be obtained by adding a modified polysiloxane having a waxy state or a rubbery state at ambient temperature, and that such a toner can be used to stably develop the electrostatic images into clear fixed images free from background for a great number of copies.

Specifically, the present invention is concerned with a toner for developing an electrostatic latent image comprising a binder resin, a colorant, and a modified polysiloxane having the general formula (1):

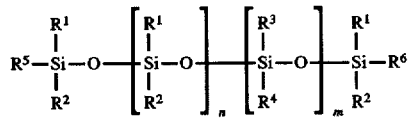

(1)

wherein $R^1$ to $R^4$, which may be identical or different, each stands for an alkyl group having 1 to 6 carbon atoms, a phenyl group, or a naphthyl group; $R^5$ and $R^6$, which may be identical or different, each stands for a linear or branched, saturated hydrocarbon group having an average number of carbon atoms of from 16 to 600; and n and m each stands for a number of zero (0) or more.

DETAILED DESCRIPTION OF THE INVENTION

The toner for developing an electrostatic latent image according to the present invention comprises a binder resin, a colorant, and a modified polysiloxane having the general formula (1):

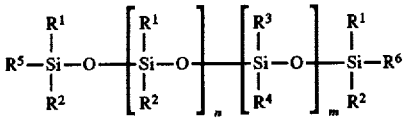

(1)

wherein $R^1$ to $R^4$, which may be identical or different, each stands for an alkyl group having 1 to 6 carbon atoms, a phenyl group, or a naphthyl group; $R^5$ and $R^6$, which may be identical or different, each stands for a linear or branched, saturated hydrocarbon group having an average number of carbon atoms of from 16 to 600; and n and m each stands for a number of 0 or greater.

In the above general formula (1), the groups represented by $R^1$ to $R^4$ may be alkyl groups listed below, a phenyl group, or a naphthyl group. Examples of the alkyl groups having 1 to 6 carbon atoms represented by $R^1$ to $R^4$ include a methyl group, an ethyl group, a propyl group, an isopropyl group, a butyl group, an s-butyl group, a t-butyl group, a pentyl group, and a hexyl group. Among the groups represented by $R^1$ to $R^4$, a preference is given to a methyl group, an ethyl group, and a phenyl group. The groups represented by $R^1$ to $R^4$ may be identical or different for each of the repeating units.

Also, in the general formula (1), the linear or branched, saturated hydrocarbon groups represented by $R^5$and $R^6$ may be identical or different, each having an average number of carbon atoms of from 16 to 600, preferably from 27 to 300, more preferably from 40 to 300. The linear or branched, saturated hydrocarbon groups preferably have an average number of carbon atoms of 16 or more in order to prevent the resulting modified polysiloxane from being in an oily state, so that the toner has good blocking resistance or good free flowability. On the other hand, the hydrocarbon groups preferably have an average number of carbon atoms of 600 or less in order to maintain good releasing ability in the resulting toner, so that the toner has good low-temperature offset resistance and is free from scratches. Examples of $R^5$ and $R^6$ include polyalkylene moieties, such as a polyethylene moiety and a polypropylene moiety.

In the above general formula (1), n and m each stands for a number of 0 or greater. It is preferred that the sum of n and m is from 5 to 3000, more preferably from 20 to 1000. Within the above-specified range, the excellent effects of the silicones are even greatly exhibited, thereby giving excellent releasing ability, offset resistance, and scratching inhibition in the resulting toner.

In the modified polysiloxane represented by the general formula (1), the weight ratio of a total amount of the saturated hydrocarbon group moiety at both ends of a molecule to the polysiloxane moiety is preferably from 80/20 to 1/99. When the proportion of the polysiloxane moiety is equal to or less than the upper limit thereof, good free flowability in the resulting toner can be maintained, and when the proportion of the saturated hydrocarbon moiety is equal to or less than the upper limit thereof, good offset resistance in the resulting toner can be maintained. In particular, in a case where the toner is produced by pulverization method, the weight ratio of a total amount of the saturated hydrocarbon group moiety at both ends of the molecule to the polysiloxane moiety is preferably from 80/20 to 10/90, more preferably from 60/40 to 15/85.

The modified polysiloxane described above may be prepared by a method comprising the following steps in a sequential order of (1), (2), (3), and (4):

(1) Subjecting ethylene monomers to anionic polymerization in the presence of at least one of a linear or branched alkyl lithium, the alkyl moiety having 1 to 6 carbon atoms and a tertiary-diamine-based initiator, to give a living polyethylene; and (2) allowing to react the living polyethylene obtained in step (1) with a cyclic siloxane having the general formula (2):

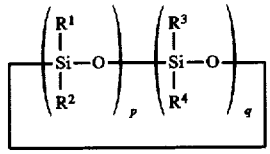

(2)

wherein $R^1$ to $R^4$, which may be identical or different, each stands for an alkyl group having 1 to 6 carbon atoms, a phenyl group, or a naphthyl group; and p and q each stands for a number of 1 or greater, and optionally treating with an acid to form a silanol, to give a modified polyethylene having an silanol group or silanolate group at one end of the molecule represented by the general formula (3):

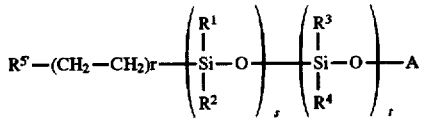

(3)

wherein $R^1$ to $R^4$ are as defined in the general formula (2); $R^{5'}$ stands for a linear or branched alkyl group having 1 to 6 carbon atoms; r stands for a number of from 1 to 300; and s and t, which may be identical or different, each stands for a number of 1 or greater; and A stands for a hydrogen atom or a lithium ion;

(3) carrying out equilibrium polymerization in the presence of an acid catalyst or a basic catalyst, the modified polyethylene represented by the general formula (3) obtained in step (2) with at least one of the following compounds:

(i) the cyclic siloxane represented by the general formula (2); and (ii) a straight-chain siloxane having hydroxyl groups at both ends of a molecule represented by the general formula (4):

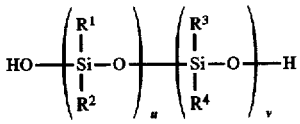

(4)

wherein $R^1$ to $R^4$, which may be identical or different, each stands for an alkyl group having 1 to 6 carbon atoms, a phenyl group, or a naphthyl group; and u and v each stands for a number of 1 or greater; and (4) neutralizing and dehydrating the product obtained in step (3).

Incidentally, the preparation of the modified polysiloxane described above may be carried out by a method similar to the method for preparation of the modified polysiloxane detailed in Japanese Patent Laid-Open No. 7-278310, the disclosure of which is reference is incorporated herein by reference.

In the present invention, the amount of the modified polysiloxane added to the toner is preferably 1.0 to 10 parts by weight, more preferably 1.0 to 5.0 parts by weight, based on 100 parts by weight of the binder resin. When the amount of the modified polysiloxane is 10 parts by weight or less, the resulting toner has a good fixing ability to the transfer paper. On the other hand, when the amount is 1.0 part by weight or more, the resulting toner has good releasing ability and offset resistance.

The method for adding the modified polysiloxane described above in the toner include a method comprising blending the modified polysiloxane with a binder resin or monomeric components of the binder resin together with other additives.

Also, one or more suitable offset inhibitors may be optionally added together with the modified polysiloxane described above for the purpose of improving the offset resistance in heat-and-pressure fixing, and examples of the offset inhibitors include polyolefins, metal salts of fatty acids, fatty acid esters, partially saponified fatty acid esters, higher fatty acids, higher alcohols, paraffin waxes, amide waxes, polyhydric alcohol esters, silicone varnishes, aliphatic fluorocarbons and silicone oils.

In the present invention, since the toner contains the modified polysiloxane, the toner has not only excellent offset resistance and releasing ability upon heat roller fixing but also excellent blocking resistance and free flowability. Also, such a toner has excellent low-temperature fixing ability.

The toner of the present invention is a toner for developing an electrostatic latent image comprising at least a binder resin (or a core material resin, in a case of an encapsulated toner) and a colorant, which may be roughly classified into the following two embodiments:

I) A toner for developing an electrostatic latent image having a non-encapsulated structure; and II) A toner for developing an electrostatic latent image having an encapsulated structure.

Toners for Embodiment I include so-called a pulverized toner and a polymerized toner, and toners for Embodiment II include encapsulated toners obtainable by various production methods.

Each of Embodiments I and II will be detailed below.

EMBODIMENT I

The toner for developing an electrostatic latent image in Embodiment I comprises at least a binder resin and a colorant, and optionally contains a charge control agent, a particulate magnetic material, and other additives.

Examples of usable binder resins include various resins, such as styrene resins, epoxy resins, polypropylene resins, vinyl ester resins, polyethylene resins, and polyester resins. Among them, from the aspect of giving good low-temperature fixing ability, resistance against migration upon contacting with vinyl chloride, and high toughness, the polyester resins detailed below are suitably used as a main component of the binder resin.

The polyester resins can be obtained by the condensation polymerization of polyhydric alcohol components and polycarboxylic acid components, namely the condensation polymerization between a polyhydric alcohol and a polycarboxylic acid, a polycarboxylic acid anhydride or a polycarboxylic ester.

Among the alcohol components, the diol components may be those represented by the following general formula (5):

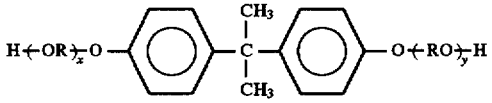

(5)

wherein R stands for an ethylene group or a propylene group; and x and y each stands for an integer of 1 or greater, wherein an average sum of x and y is from 2 to 7.

Examples thereof include polyoxypropylene(2.2)-2,2-bis(4-hydroxyphenyl)propane, polyoxypropylene(3.3)-2,2-bis(4-hydroxyphenyl)propane, polyoxyethylene(2.0)-2,2-bis(4-hydroxyphenyl)propane, polyoxypropylene(2.0)-polyoxyethylene(2.0)-2,2-bis(4-hydroxyphenyl)propane, and polyoxypropylene(6)-2,2-bis(4-hydroxyphenyl)propane.

In addition, in certain cases, ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, and other diols, bisphenol A, hydrogenated bisphenol A, propylene adducts of bisphenol A, ethylene adducts of bisphenol A, and other dihydric alcohols may be also added.

Among these diol components, propylene adducts of bisphenol A and ethylene adducts of bisphenol A are preferably used.

These diol components are hereinafter referred to as "ingredient (a)."

The dicarboxylic acids, the acid anhydrides thereof, and the carboxylic esters thereof include the following:

Examples of the dicarboxylic acid components include maleic acid, fumaric acid, citraconic acid, itaconic acid, glutaconic acid, phthalic acid, isophthalic acid, terephthalic acid, cyclohexanedicarboxylic acid, succinic acid, adipic acid, sebacic acid, azelaic acid, and malonic acid; and alkylsuccinic or alkenylsuccinic acids, such as n-butylsuccinic acid, n-butenylsuccinic acid, isobutylsuccinic acid, isobutenylsuccinic acid, n-octylsuccinic acid, n-octenylsuccinic acid, isooctylsuccinic acid, isobutenylsuccinic acid, n-dodecylsuccinic acid, n-dodecenylsuccinic acid, isododecylsuccinic acid, and isododecenylsuccinic acid. Also, acid anhydrides of these dicarboxylic acids, lower alkyl esters thereof, and other dicarboxylic acid components are also included.

These dicarboxylic acid components are hereinafter referred to as "ingredient (b)."

Trivalent or higher polyfunctional components may be the trihydric or higher polyhydric alcohols, the tricarboxylic or higher polycarboxylic acids, the acid anhydrides thereof, and the carboxylic esters thereof. Examples thereof include the following:

Examples of the trihydric or higher polyhydric alcohol components include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, 1,3,5-trihydroxymethylbenzene, and other trihydric or higher polyhydric alcohol components.

Examples of the tricarboxylic or higher polycarboxylic acid components include 1,2,4-benzenetricarboxylic acid (trimellitic acid), 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, Empol trimer acid, acid anhydrides thereof, lower alkyl esters thereof, and other tricarboxylic or higher polycarboxylic acid components.

In addition, examples of polycarboxylic acids include a tetracarboxylic acid having the following general formula (6):

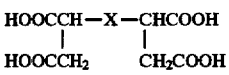

(6)

wherein X stands for an alkylene group or an alkenylene group, each having from 5 to 30 carbon atoms and having one or more side chains each with 3 or more carbon atoms.

Examples thereof include the following items (1) to (12):

(1) 4-Neopentylidenyl-1,2,6,7-heptanetetracarboxylic acid;

(2) 4-Neopentyl-1,2,6,7-heptene(4)-tetracarboxylic acid; (3) 3-Methyl-4-heptenyl-1,2,5,6-hexanetetracarboxylic acid;

(4) 3-Methyl-3-heptyl-5-methyl-1,2,6,7-heptene(4)-tetracarboxylic acid;

(5) 3-Nonyl-4-methyldenyl-1,2,5,6-hexanetetracarboxylic acid;

(6) 3-Decylidenyl-1,2,5,6-hexanetetracarboxylic acid;

(7) 3-Nonyl-1,2,6,7-heptene(4)-tetracarboxylic acid;

(8) 3-Decenyl-1,2,5,6-hexanetetracarboxylic acid;

(9) 3-Butyl-3-ethylenyl-1,2,5,6-hexanetetracarboxylic acid;

(10) 3-Methyl-4-butylidenyl-1,2,6,7-heptanetetracarboxylic acid;

(11) 3-Methyl-4-butyl-1,2,6,7-heptene(4)-tetracarboxylic acid; and

(12) 3-Methyl-5-octyl-1,2,6,7-heptene(4)-tetracarboxylic acid.

The trivalent or higher polyfunctional components, including the trihydric or higher polyhydric alcohol components and the tricarboxylic or higher polycarboxylic acid components, are collectively referred to as "ingredient (c)."

In Embodiment I, these dicarboxylic acid components and tricarboxylic or higher polycarboxylic acid components may be used singly or in combination.

Also, the dihydric alcohol components and trihydric or higher polyhydric alcohol components may be used singly or in combination.

The polyester resins in Embodiment I are obtainable by carrying out condensation polymerization of the above polyhydric alcohol components and the polycarboxylic acid components. For instance, the condensation polymerization may be carried out at a temperature of from 180° to 250° C. in an inert gas atmosphere. In order to accelerate the above reaction, conventionally used esterification catalysts, such as zinc oxide, tin (II) oxide, dibutyltin oxide, and dibutyltin dilaurate, may be used. To achieve the same purpose, the polyester resins may be prepared under a reduced pressure.

Examples of the polyester resins produced by the above method include the following:

1) Polyester Resin (1)

A polyester resin containing insoluble ethyl acetate component in an amount of 3.0% by weight or more (Japanese Patent Laid-Open No. 62-195676).

2) Polyester Resin (2)

A polyester resin obtained by condensation polymerization reaction between:

(i) a diol component as exemplified by "ingredient (a)" given above;

(ii) a dicarboxylic acid component including a dicarboxylic acid, an acid anhydride thereof, and a lower alkyl ester thereof, the dicarboxylic acid component as being exemplified by "ingredient (b)" given above; and (iii) a tricarboxylic acid component including a tricarboxylic or higher polycarboxylic acid, an acid anhydride thereof, or a lower alkyl ester thereof, or a trihydric or higher polyhydric alcohol component, the tricarboxylic or higher polycarboxylic acid component and trihydric alcohol components being as exemplified by "ingredient (c)" given above (Japanese Patent Laid-Open No. 62-195677).

3) Polyester Resin (3)

A polyester resin obtained by condensation polymerization reaction between:

(i) a diol component as exemplified by "ingredient (a)" given above;

(ii) a dicarboxylic acid component including a dicarboxylic acid, an acid anhydride thereof, or a lower alkyl ester thereof, the dicarboxylic acid component as being exemplified by "ingredient (b)" given above, wherein an alkylsuccinic or alkenylsuccinic acid is contained in an amount of 5 to 50 mol % of the entire carboxylic acid component; and (iii) a tricarboxylic acid component including a tricarboxylic or higher polycarboxylic acid, an acid anhydride thereof, or a lower alkyl ester thereof, or a trihydric or higher polyhydric alcohol component, the tricarboxylic or higher polycarboxylic acid component and the trihydric or higher polyhydric alcohol component as being exemplified by "ingredient (c)" given above (Japanese Patent Laid-Open No. 62-195678).

4) Polyester Resin (4)

A polyester resin obtained by condensation polymerization reaction between:

(i) a diol component as exemplified by "ingredient (a)" given above;

(ii) a dicarboxylic acid component including a dicarboxylic acid, an acid anhydride thereof, or a lower alkyl ester thereof, the dicarboxylic acid component as being exemplified by "ingredient (b)" given above, wherein an alkylsuccinic or alkenylsuccinic acid is contained in an amount of 5 to 50 mol % in the entire carboxylic acid component; and (iii) a tricarboxylic acid component including a tricarboxylic or higher polycarboxylic acid, an acid anhydride thereof, or a lower alkyl ester thereof, whose examples are given as the tricarboxylic or higher polycarboxylic acid components in the "ingredient (c)" given above, wherein a tetracarboxylic acid having the general formula (6):

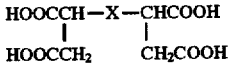

(6)

wherein X stands for an alkylene group or an alkenylene group, each having from 5 to 30 carbon atoms and having one or more side chains each with 3 or more carbon atoms, or an acid anhydride thereof, or a lower alkyl ester, is contained in an amount of 0.1 to 20 mol % in the entire carboxylic acid component (Japanese Patent Laid-Open No. 62-195679).

5) Polyester Resin (5)

A polyester resin obtained by condensation polymerization reaction between:

(i) a diol component as exemplified by "ingredient (a)" above;

(ii) a dicarboxylic acid component including a dicarboxylic acid, an acid anhydride thereof, or a lower alkyl ester thereof, the dicarboxylic acid component as being exemplified by "ingredient (b);"

(iii) a trihydric or higher polyhydric alcohol component whose examples are given as the trihydric or higher polyhydric alcohol component in "ingredient (c)" given above; and (iv) a tricarboxylic acid component including a tricarboxylic or higher polycarboxylic acid, an acid anhydride thereof, or a lower alkyl ester thereof, whose examples are given as the tricarboxylic or higher polycarboxylic acid components in "ingredient (c)" given above (Japanese Patent Laid-Open No. 62-195680).

In the polyester resins, unless transesterification reactions or reactions of the polyester resins with a monocarboxylic acid and/or monohydric alcohol are carried out, carboxyl groups and/or hydroxyl groups remain at terminus of the polyester molecule. It is confirmed that the level of the triboelectric charges of the polyester itself changes depending upon the amount of groups remaining at terminus. In other words, as for the amount of the groups remaining at terminus, when the acid value of the polyester resin is higher than the lower limit thereof, good level of the triboelectric charges of the polyester resin can be maintained. On the other hand, when the acid value is lower than the upper limit thereof, the resulting toner is less likely to have environmental dependency, thereby making it suitable to use such a toner in a developer composition. For the reasons given above, the polyester resins having acid values of from 5 to 60 KOH mg/g are generally used for toners. The toners comprising a polyester resin having an OHV/AV value of 1.2 or more are preferred, wherein AV stands for an acid value for a polyester resin, and OHV stands for a hydroxyl value for a polyester resin. The reasons why such toners are preferred are not strictly clear but presumably as follows. Such a toner gives good free flowability, and the lowest fixing temperature can be lowered when using such toners.

The polyester resins in Embodiment I are those polyester resins as exemplified by items 1) to 5), and the polyester resins having an OHV/AV value of 1.2 or higher are used for the reasons given above. Here, AV and OHV are each measured by the method according to JIS K 0070. In this case, when the insoluble ethyl acetate component is 3.0% by weight or more, the solvent for measuring acid value may be desirably dioxane.

The OHV/AV values may be easily adjusted to be in the range of 1.2 or higher by having an alcohol-rich composition, namely that having a larger number of functional groups for the alcohol components than that for the carboxylic acid components (See Japanese Patent Laid-Open Nos. 62-195677, 62-195678, 63-68849, 63-68850, 63-163469, and 1-155362.).

The polyester resins in Embodiment I are used as a main component of the binder resin, and other resins may be contained in the binder resins in an amount up to 30% by weight, the other resins being, for instance, styrene resins or styrene-acrylic resins, each having a number-average molecular weight of 11,000 or less in order to improve the pulverizability upon preparation of toners. Property improvers, such waxes, may be added as offset inhibitors during the toner preparation. However, in a case where a binder resin comprises a polyester resin according to Embodiment I as a main component, these property improvers are not necessary. Even if they are used, they are contained in a small amount.

The colorants are not particularly limitative, and any of the known ones can be used, including inorganic pigments such as conventionally known carbon blacks and iron blacks; dyes of chromatic colors; and organic pigments. Examples of the colorants used in the present invention include various carbon blacks which may be produced by a thermal black method, an acetylene black method, a channel black method, and a lamp black method; a grafted carbon black, in which the surface of carbon black is coated with a resin; a nigrosine dye, Phthalocyanine Blue, Permanent Brown FG, Brilliant Fast Scarlet, Pigment Green B, Rhodamine-B Base, Solvent Red 49, Solvent Red 146, Solvent Blue 35, and the mixtures thereof. The colorant is preferably used in an amount of about 1 to 15 parts by weight, based on 100 parts by weight of the binder resin.

Also, a charge control agent may be optionally added thereto. Negative charge control agents used for negatively chargeable toners may be one or more selected from all sorts of negative charge control agents conventionally used for electrophotography, and examples thereof include azo dyes containing metals such as "VARIFAST BLACK 3804" (manufactured by Orient Chemical Co., Ltd.), "BONTRON S-31" (manufactured by Orient Chemical Co., Ltd.), "BONTRON S-32" (manufactured by Orient Chemical Co., Ltd.), "BONTRON S-34" (manufactured by Orient Chemical Co., Ltd.), "BONTRON S-36" (manufactured by Orient Chemical Co., Ltd.), "AIZEN SPILON BLACK TRH" (manufactured by Hodogaya Chemical Co., Ltd.), and "T-77" (manufactured by Hodogaya Chemical Co., Ltd.); copper phthalocyanine dyes; metal complexes of alkyl derivatives of salicylic acid, such as "BONTRON E-82" (manufactured by Orient Chemical Co., Ltd.), "BONTRON E-84" (manufactured by Orient Chemical Co., Ltd.), and "BONTRON E-85" (manufactured by Orient Chemical Co., Ltd.); and quaternary ammonium salts such as "COPY CHARGE NX VP434" (manufactured by Hoechst), with a preference given to BONTRON S-34, T-77, and AIZEN SPILON BLACK TRH.

In the negatively chargeable toners, the above negative charge control agents used as a main charge control agent may be used in combination with a positive charge control agent. In this case, the positive charge control agent may be added in an amount of one-half that or less of the negative charge control agent, so that a decrease in image density does not take place even after continuous development of not less than 50,000 sheets, thereby making it possible to obtain excellent visualized images.

Also, positive charge control agents used for positively chargeable toners may be one or more selected from all sorts of positive charge control agents conventionally used for electrophotography, and examples thereof include nigrosine dyes such as "NIGROSINE BASE EX" (manufactured by Orient Chemical Co., Ltd.), "OIL BLACK BS" (manufactured by Orient Chemical Co., Ltd.), "OIL BLACK SO" (manufactured by Orient Chemical Co., Ltd.), "BONTRON N-01" (manufactured by Orient Chemical Co., Ltd.), "BONTRON N-07" (manufactured by Orient Chemical Co., Ltd.), and "BONTRON N-11" (manufactured by Orient Chemical Co., Ltd.); triphenylmethane dyes containing tertiary amines as side chains; quaternary ammonium salt compounds such as "BONTRON P-51" (manufactured by Orient Chemical Co., Ltd.), and cetyltrimethylammonium bromide; polyamine resins such as "AFP-B" (manufactured by Orient Chemical Co., Ltd.), with a preference given to BONTRON N-07 and AFP-B.

The above charge control agents may be contained in the binder resin in an amount of 0.1 to 8.0% by weight, preferably 0.2 to 5.0% by weight.

Further, when a magnetic toner is prepared, particulate magnetic materials may be incorporated therein. Examples of the particulate magnetic materials may be materials which are magnetized in the magnetic field, including ferromagnetic metals such as iron, cobalt, and nickel, alloys and compounds containing these elements, such as magnetite, hematite, and ferrite. Such a particulate magnetic material is preferably dispersed in an amount of about 15 to 70 parts by weight, based on 100 parts by weight of the entire toner weight.

The toners for developing electrostatic latent images of the present invention according to Embodiment I can be prepared by any of conventionally known methods without limitation. For instance, a method of kneading, pulverizing and classifying, or a method of directly preparing a toner by carrying out polymerization reaction while suspending a polymerizable composition comprising polymerizable monomers, a polymerization initiator, and a colorant in an aqueous dispersing medium. Further, free flow agents, such as hydrophobic silica, and metal oxides may be externally added to the resulting untreated toner.

EMBODIMENT II

The toner for developing an electrostatic latent image according to Embodiment II is an encapsulated toner for heat-and-pressure fixing comprising a heat-fusible core material comprising at least a thermoplastic resin and a colorant, and a shell formed thereon so as to cover the surface of the core material.

The encapsulated toner in Embodiment II may be prepared by various method, some of which may be exemplified below.

(1) An interfacial polymerization method comprising supplying monomeric components separately from a liquid-liquid phase immiscible to each other, and polymerizing the monomeric components at interface, to thereby form a shell.

(2) A complex coacervation method comprising allowing a phase separation to take place at the periphery of the core material in a liquid mixture comprising ionic polymer colloids and the core material.

(3) In situ polymerization comprising polymerizing the core material monomeric components in the dispersed phase and concurrently localizing a shell formed in the periphery of the core material at the interface of the dispersed phase owing to the difference in the solubility indices of the shell material.

(4) A spray-drying method comprising dispersing core substances in a polymer non-aqueous solution or polymer emulsion, and spray-drying the dispersion liquid.

These preparation methods are disclosed, for instance, in Japanese Patent Laid-Open Nos. 58-176642, 58-176643, 61-56352, 63-128357, 63-128358, 1-267660, 2-51175, 4-212169, and 6-130713, the disclosures of which are incorporated herein by reference.

In the present invention, among the above preparation methods (1) to (4), from the aspects of low-temperature fixing ability, offset resistance, and blocking resistance, a preference is given to an encapsulated toner having a shell comprising an amorphous polyester as a main component thereof, the shell being formed by in situ polymerization. The present invention will be detailed below taking such a toner as a preferred embodiment.

The amorphous polyester in the present invention can generally be obtained by a condensation polymerization between at least one alcohol component selected from the group consisting of dihydric alcohol components and trihydric or higher polyhydric alcohol components and at least one carboxylic acid component selected from the group consisting of dicarboxylic acid components and tricarboxylic or higher polycarboxylic acid components. Among them, the amorphous polyesters obtained by the condensation polymerization of components containing a dihydric alcohol component and a dicarboxylic acid component, and further at least a trihydric or higher polyhydric alcohol component and/or a tricarboxylic or higher polycarboxylic acid component are suitably used.

Examples of the dihydric alcohol components include bisphenol A alkylene oxide adducts such as polyoxypropylene(2.2)-2,2-bis(4-hydroxyphenyl)propane, polyoxypropylene(3.3)-2,2-bis(4-hydroxyphenyl)propane, polyoxypropylene(2.0)-2,2-bis(4-hydroxyphenyl)propane, polyoxypropylene(2.0)-polyoxyethylene(2.0)-2,2-bis(4-hydroxyphenyl)propane, and polyoxypropylene(6)-2,2-bis(4-hydroxyphenyl)propane; ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, polytetramethylene glycol, bisphenol A, propylene adduct of bisphenol A, ethylene adduct of bisphenol A, hydrogenated bisphenol A, and other dihydric alcohols.

Examples of the trihydric or higher polyhydric alcohol components include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, 1,3,5-trihydroxymethylbenzene, and other trihydric or higher polyhydric alcohols. Among them, the trihydric alcohols are preferably used.

In Embodiment II, these dihydric alcohol components and trihydric or higher polyhydric alcohol components may be used singly or in combination.

As for the acid components, examples of the dicarboxylic acid components include maleic acid, fumaric acid, citraconic acid, itaconic acid, glutaconic acid, phthalic acid, isophthalic acid, terephthalic acid, succinic acid, adipic acid, sebacic acid, azelaic acid, malonic acid, n-dodecenylsuccinic acid, n-dodecylsuccinic acid, n-octylsuccinic acid, isooctenylsuccinic acid, isooctylsuccinic acid, and acid anhydrides thereof, lower alkyl esters thereof, and other dicarboxylic acids.

Examples of the tricarboxylic or higher polycarboxylic acid components include 1,2,4-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, Empol trimer acid, and acid anhydrides thereof, lower alkyl esters thereof and other tricarboxylic or higher polycarboxylic acids.

These dicarboxylic acid components and tricarboxylic or higher polycarboxylic acid components may be used singly or in combination.

The method for producing an amorphous polyester in the present invention is not particularly limitative, and the amorphous polyester can be produced by esterification or transesterification of the above monomeric components.

Here, "amorphous" refers to those which do not have a definite melting point.

The amorphous polyester thus obtained preferably has a glass transition temperature of from 50° to 80° C., more preferably 55° to 70° C. The glass transition temperature of the amorphous polyester is preferably 50° C. or higher, from the aspect of maintaining good storage stability of the resulting toner, and the glass transition temperature is preferably 80° C. or lower, from the aspect of maintaining good fixing ability of the resulting toner.

Here, "glass transition temperature" used herein refers to the temperature of an intersection of the extension of the baseline of not more than the glass transition temperature and the tangential line showing the maximum inclination between the kickoff of the peak and the top thereof as determined using a differential scanning calorimeter ("DSC Model 210," manufactured by Seiko Instruments, Inc.), at a temperature rise rate of 10° C./min.

The acid value of the above amorphous polyester is preferably 3 to 50 KOH mg/g, more preferably 5 to 30 KOH mg/g. Here, the acid value is measured according to JIS K0070.

On the other hand, since the resin usable for the main component of a heat-fusible core material in the encapsulated toner may be the same ones as the binder resin in Embodiment I, with a preference given to vinyl resins. The glass transition temperatures ascribed to the thermoplastic resin used as the main component of the heat-fusible core material described above are preferably 10° C. to 50° C., more preferably 20° C. to 40° C. The glass transition temperature is preferably 10° C. or higher, from the aspect of having good storage stability in the encapsulated toner, and the glass transition temperature is preferably 50° C. or less, from the aspect of having good fixing strength of the resulting encapsulated toner.

Among the above-mentioned thermoplastic resins, examples of the monomers constituting the vinyl resins include styrene and styrene derivatives, such as styrene, o-methylstyrene, m-methylstyrene, p-methylstyrene, α-methylstyrene, p-ethylstyrene, 2,4-dimethylstyrene, p-chlorostyrene, and vinylnaphthalene; ethylenic unsaturated monoolefins, such as ethylene, propylene, butylene, and isobutylene; vinyl esters, such as vinyl chloride, vinyl bromide, vinyl fluoride, vinyl acetate, vinyl propionate, vinyl formate, and vinyl caproate; ethylenic monocarboxylic acids and esters thereof, such as acrylic acid, methyl acrylate, ethyl acrylate, n-propyl acrylate, isopropyl acrylate, n-butyl acrylate, isobutyl acrylate, t-butyl acrylate, amyl acrylate, cyclohexyl acrylate, n-octyl acrylate, isooctyl acrylate, decyl acrylate, lauryl acrylate, 2-ethylhexyl acrylate, stearyl acrylate, methoxyethyl acrylate, 2-hydroxyethyl acrylate, glycidyl acrylate, 2-chloroethyl acrylate, phenyl acrylate, methyl α-chloroacrylate, methacrylic acid, methyl methacrylate, ethyl methacrylate, n-propyl methacrylate, isopropyl methacrylate, n-butyl methacrylate, isobutyl methacrylate, t-butyl methacrylate, amyl methacrylate, cyclohexyl methacrylate, n-octyl methacrylate, isooctyl methacrylate, decyl methacrylate, lauryl methacrylate, 2-ethylhexyl methacrylate, stearyl methacrylate, methoxyethyl methacrylate, 2-hydroxyethyl methacrylate, glycidyl methacrylate, phenyl methacrylate, dimethylaminoethyl methacrylate, and diethylaminoethyl methacrylate; substituted monomers of ethylenic monocarboxylic acids, such as acrylonitrile, methacrylonitrile, and acrylamide; ethylenic dicarboxylic acids and substituted monomers thereof, such as dimethyl maleate; vinyl ketones, such as vinyl methyl ketone; vinyl ethers, such as vinyl methyl ether; vinylidene halides, such as vinylidene chloride; and N-vinyl compounds, such as N-vinylpyrrole and N-vinylpyrrolidone.

Among the above core material resin-constituting components in Embodiment II, it is preferred that styrene or styrene derivatives is used in an amount of 50 to 90% by weight to form the main structure of the resins, and that the ethylenic monocarboxylic acid or esters thereof is used in an amount of 10 to 50% by weight to adjust the thermal properties such as the softening point of the resins, because the glass transition temperature of the core material resin can be controlled easily.

A crosslinking agent may be optionally added to the monomer composition. In such a case, any known crosslinking agents may be suitably used. Examples of crosslinking agents added to monomer compositions constituting the core material resins include any of the generally known crosslinking agents such as divinylbenzene, divinylnaphthalene, polyethylene glycol dimethacrylate, diethylene glycol diacrylate, triethylene glycol diacrylate, 1,3-butylene glycol dimethacrylate, 1,6-hexylene glycol dimethacrylate, neopentyl glycol dimethacrylate, dipropylene glycol dimethacrylate, polypropylene glycol dimethacrylate, 2,2'-bis(4-methacryloxydiethoxyphenyl) propane, 2,2'-bis(4-acryloxydiethoxyphenyl)propane, trimethylolpropane trimethacrylate, trimethylolpropane triacrylate, tetramethylolmethane tetraacrylate, dibromoneopentyl glycol dimethacrylate, and diallyl phthalate. Among them, a preference is given to divinylbenzene and polyethylene glycol dimethacrylate. These crosslinking agents may be used alone or, if necessary, in a combination of two or more.

The amount of these crosslinking agents used is preferably from 0.001 to 15% by weight, more preferably 0.1 to 10% by weight, based on the polymerizable monomers. The amount of these crosslinking agents used is preferably 15 parts by weight or less, from the aspect of having easy melting of the resulting toner upon heating, thereby resulting in good heat fixing ability and heat-and-pressure fixing ability. In addition, the amount of the crosslinking agents used is preferably 0.001 parts by weight or more, from the aspect of inhibiting offset phenomenon in the heat-and-pressure fixing. When an offset phenomenon takes place in the heat-and-pressure fixing, a part of the toner cannot be completely fixed on a paper but rather adheres to the surface of a roller, thereby being transferred to a subsequent paper.

Examples of the polymerization initiators to be used in the production of the thermoplastic resin for the core material include azo and diazo polymerization initiators such as 2,2'-azobis(2,4-dimethylvaleronitrile), 2,2'-azobisisobutyronitrile, 1,1'-azobis(cyclohexane-1-carbonitrile), and 2,2'-azobis-4-methoxy-2,4-dimethylvaleronitrile; and peroxide polymerization initiators such as benzoyl peroxide, methyl ethyl ketone peroxide, isopropyl peroxycarbonate, cumene hydroperoxide, 2,4-dichlorobenzoyl peroxide, lauroyl peroxide, and dicumyl peroxide.

For the purposes of controlling the molecular weight or molecular weight distribution of the resulting polymer or controlling the reaction time, two or more polymerization initiators may be used in combination. The amount of the polymerization initiator used is preferably from 0.1 to 20 parts by weight, more preferably from 1 to 10 parts by weight, based on 100 parts by weight of the polymerizable monomers.

Also, in Embodiment II, a charge control agent may be optionally added to the core material. Examples of the negative charge control agents and the positive charge control agents may be the same ones as those listed in Embodiment I.

Here, the charge control agents may be preferably contained in the core material in an amount of 0.1 to 8.0% by weight, more preferably 0.2 to 5.0% by weight.

In addition, one or more suitable offset inhibitors as exemplified above may be optionally incorporated in the core material for the purpose of improving the offset resistance in heat-and-pressure fixing.

In Embodiment II of the present invention, a colorant is contained in the core material of the encapsulated toner, and any of the conventional dyes or pigments, which are used for colorants for the toners may be used.

Examples of the colorants used in Embodiment II of the present invention include various carbon blacks which may be produced by a thermal black method, an acetylene black method, a channel black method, and a lamp black method; a grafted carbon black, in which the surface of carbon black is coated with a resin; a nigrosine dye, Phthalocyanine Blue, Permanent Brown FG, Brilliant Fast Scarlet, Pigment Green B, Rhodamine-B Base, Solvent Red 49, Solvent Red 146, Solvent Blue 35, and the mixtures thereof. The colorant is preferably used in an amount of about 1 to 15 parts by weight based on 100 parts by weight of the resin contained in the core material.

When a magnetic encapsulated toner is prepared, particulate magnetic materials may be incorporated in the core material, and examples of the particulate magnetic materials may be the same ones as those given in Embodiment I. Such a particulate magnetic material is preferably dispersed in an amount of from 20 to 70 parts by weight, more preferably from 30 to 70 parts by weight, based on 100 parts by weight of the entire encapsulated toner.

The method for production of the encapsulated toner using the above starting materials will be described hereinbelow.

In this method for production by in situ polymerization, the shell can be formed by utilizing such property that when a liquid mixture comprising the core material-constituting material and the shell-forming material such as amorphous polyesters is dispersed in an aqueous dispersing medium, the shell-forming material localizes onto the surface of the liquid droplets. Specifically, the separation of the core material-constituting material and the shell-forming material in the liquid droplets of the liquid mixture takes place owing to the difference in the solubility indices, and the polymerization proceeds in this state to form an encapsulated structure. By this method, since a shell is formed as a layer of shell-forming materials with a substantially uniform thickness, so that the triboelectric chargeability of the toner becomes uniform.

Incidentally, a general method of encapsulation by in situ polymerization is carried out by supplying monomers for shell-forming resins, polymerization initiators, etc. from either one of the inner phase or outer phase of the dispersed phase and forming a shell resin by polymerization to give an encapsulated structure (see *Microcapsule*, T. Kondo and N. Koishi, 1987, published by Sankyo Shuppan Kabushiki Kaisha). On the other hand, in in situ polymerization in Embodiment II, since the core material resin is formed in the inner portion of the shell resin by polymerizing monomeric components for the core material resins in the presence of the polymerization initiator, the encapsulation mechanism in the present invention is somewhat different from that of the general encapsulation in in situ polymerization method. However, since in the method in Embodiment II of the present invention, the monomers are supplied only from the inner phase of the dispersed phase, the method in Embodiment II may be a sort of in situ polymerization in a broader sense.

In a case where the encapsulated toner is prepared by the method in Embodiment II, a dispersion stabilizer is added into the dispersing medium in order to prevent agglomeration and coalescence of the dispersed substances.

Examples of the dispersion stabilizers include gelatin, gelatin derivatives, polyvinyl alcohols, polystyrenesulfonic acids, hydroxymethylcellulose, hydroxyethylcellulose, hydroxypropylcellulose, sodium carboxymethylcellulose, sodium polyacrylates, sodium dodecylbenzenesulfonate, sodium tetradecyl sulfate, sodium pentadecyl sulfate, sodium octyl sulfate, sodium allyl alkyl polyethersulfonates, sodium oleate, sodium laurate, sodium caprate, sodium caprylate, sodium caproate, potassium stearate, calcium oleate, sodium 3,3-disulfonediphenylurea-4,4-diazobisamino-β-naphthol-6-sulfonate, o-carboxybenzeneazodimethylaniline, sodium 2,2,5,5-tetramethyltriphenylmethane-4,4-diazobis-β-naphtholdisulfonate, colloidal silica, alumina, tricalcium phosphate, ferrous hydroxide, titanium hydroxide, and aluminum hydroxide, with a preference given to tricalcium phosphate. These dispersion stabilizers may be used alone or in combination of two or more.

Examples of the dispersing media for dispersing the above dispersion stabilizers include water, methanol, ethanol, propanol, butanol, ethylene glycol, glycerol, acetonitrile, acetone, isopropyl ether, tetrahydrofuran, and dioxane, among which water is preferably used as an essential component. These dispersing media can be used singly or in combination.

In the method for the production of the present invention, the amount of the above shell-forming resin as the main component is preferably 3 to 50 parts by weight, more preferably 5 to 40 parts by weight, still more preferably 8 to 30 parts by weight, based on 100 parts by weight of the core material. The amount of the shell-forming resin is preferably 3 parts by weight or more, from the viewpoint of maintaining good storage stability of the resulting toner, and the amount of the shell-forming resins is preferably 50 parts by weight or less from the viewpoint of maintaining good production stability.

Although the particle size of the encapsulated toner produced by the method described above is not particularly limitative, the average particle size is preferably 3 to 30 μm. The thickness of the shell of the encapsulated toner is preferably 0.01 to 1 μm. The thickness of the shell is preferably 0.01 μm or more, from the aspect of having good blocking resistance of the resulting toner, the thickness is preferably 1 μm or less, from the aspect of having good heat fusibility of the resulting toner.

The toners for developing electrostatic latent images according to Embodiment I and Embodiment II are described in detail above. In the toners of the present invention, a free flow agent, or a cleanability improver may be optionally added. Examples of the free flow agents include silica, alumina, titanium oxide, barium titanate, magnesium titanate, calcium titanate, strontium titanate, zinc oxide, quartz sand, clay, mica, wollastonite, diatomaceous earth, chromium oxide, cerium oxide, red oxide, antimony trioxide, magnesium oxide, zirconium oxide, barium sulfate, barium carbonate, calcium carbonate, silicon carbide, and silicon nitride, with a preference given to finely powdered silica.

The finely powdered silica is a fine powder having Si—O—Si linkages, which may be prepared by either the dry process or the wet process. The finely powdered silica may be not only anhydrous silicon dioxide but also any one of aluminum silicate, sodium silicate, potassium silicate, magnesium silicate, and zinc silicate, with a preference given to those containing 85% by weight or more of $SiO_2$. Further, finely powdered silica surface-treated with a silane coupling agent, a titanium coupling agent, silicone oil, and silicone oil having amine in the side chain thereof can be used.

The cleanability improvers include metal salts of higher fatty acids typically exemplified by zinc stearate.

Further, for the purpose of controlling the developability of the encapsulated toner, finely powdered polymers of methyl methacrylate or butyl methacrylate may be added.

Furthermore, for the purpose of toning or reducing electric resistance on the surface of the toner, a small amount of carbon black may be used. The carbon blacks may be those conventionally known, including various kinds such as furnace black, channel black, and acetylene black.

The toners for developing electrostatic latent images of the present invention are applicable for various kinds of developing methods, including, for instance, magnetic brush developing methods, cascade developing methods, methods using conductive magnetic toners, methods using high-resistive magnetic toners, fur brush developing methods, powder cloud methods, and impression developing methods.

When the toner of the present invention contains particulate magnetic materials, it can be used alone as a developer, while when the toner does not contain any particulate magnetic material, a non-magnetic one-component developer or a two-component developer can be prepared by mixing the toner with a carrier. Although the carrier is not particularly limited, examples thereof include iron powder, ferrite, glass beads, those of above with resin coatings, and resin carriers in which magnetite fine powders or ferrite fine powders are blended into the resins. The mixing ratio of the toner to the carrier is 0.5 to 20% by weight. The particle size of the carrier is 15 to 500 μm.

When the encapsulated toner of Embodiment II of the present invention is fixed on a recording medium such as paper by heat and pressure, an excellent fixing strength is attained. As for the heat-and-pressure fixing process to be suitably used in the fixing of the toner of the present invention, any one may be used as long as both heat and pressure are utilized. Examples of the fixing processes which can be suitably used in the present invention include a known heat roller fixing process; a fixing process as disclosed in Japanese Patent Laid-Open No. 2-190870 in which visible images formed on a recording medium in an unfixed state are fixed by heating and fusing the visible images through the heat-resistant sheet with a heating means, comprising a heating portion and a heat-resistant sheet; and a heat-and-pressure process as disclosed in Japanese Patent Laid-Open No. 2-162356 in which the formed visible images are fixed on a recording medium through a film by using a heating element fixed to a support and a pressing member arranged opposite to the heating element in contact therewith under pressure.

The toner for developing electrostatic latent images of the present invention exhibits excellent offset resistance and releasing ability upon heat roller fixing, and also exhibits excellent blocking resistance, free flowability and low-temperature fixing ability.

EXAMPLES

The present invention will be explained in further detail by means of the following working examples, without intending to restrict the scope of the present invention thereto.

Preparation Example 1 for Modified Polysiloxane (WAX A)

In a nitrogen gas-replaced, one-liter autoclave, 400 ml of dried cyclohexane, 3 ml of tetramethylethylenediamine, and 12.5 ml of a cyclohexane solution (0.02 mol) of n-butyl lithium (1.6 mol/liter) were placed. 8.2 liters of an ethylene gas was supplied while maintaining a reaction temperature of 30° C. and an ethylene gas supplying pressure of 2 kg/cm$^2$ to polymerize ethylene monomers, to thereby give living polymerization. Thereafter, an excess ethylene gas was removed, and the gas in the autoclave was replaced with a nitrogen gas.

Next, in a one-liter recover flask, a solution comprising 11.8 g of octamethylcyclotetrasiloxane and 10 ml of dried cyclohexane which was previously prepared was added dropwise to the reaction mixture under a nitrogen gas stream. After the completion of the dropwise addition, the mixture was allowed to react at 30° C. for one hour, and then the reaction mixture was added to two liters of methanol. After stirring the contents for one hour, the mixture was filtered under a reduced pressure, and the formed solid was collected. The collected solid was dried in an oven at 50° C. under vacuum for 24 hours, to give a white, waxy solid. The yield was 12.0 g. The product was analyzed by gel permeation chromatography (GPC) (GPC analyzer being manufactured by Waters Corporation, orthodichlorobenzene, 135° C., calibrated by standard samples of polyethylene). As a result, its weight-average molecular weight was found to be 610, and a molecular weight distribution (Mw/Mn) was 1.03. Also, the product was analyzed by $^1$H-NMR (NMR analyzer being manufactured by Bruker, 200 MHz, chloroform-d, 50° C., TMS being used as a standard). As a result, peaks assigned to following groups were observed:

–0.05 ppm (singlet): a methyl group bonded to a silyl group;

0.4 ppm (triplet): a methylene group bonded to a silyl group;

0.8 ppm (triplet): a methyl group at both ends of the main chain;

near 1.2 ppm: a methylene group of the main chain.

From the integral ratio of each peak, it was determined that the percentage for introducing a terminus silanol group was 99%. Also, the number of the siloxane units introduced was in average 1.4 per each polyethylene terminus.

Next, in a one-liter separable flask equipped with a reflux condenser, 12.0 g of the terminus silanol group-modified polyethylene prepared above, 88 g of octamethylcyclotetrasiloxane, and 100 ml of toluene were placed. The contents were heated on an oil bath until toluene was refluxed. When all of the starting materials were uniformly dissolved, 0.01 g of potassium hydroxide was added thereto, and the refluxing of the mixture was carried out for another 48 hours. Thereafter, 0.18 ml of 1N alcohol solution of hydrochloric acid was added to the resulting mixture, and the mixture was sufficiently stirred. Then, water was added, and having confirmed that the pH of the obtained mixture is 7, the formed inorganic salt was extracted by water. Rinsing with water was performed three times under heating. Thereafter, the reflux condenser of the separable flask was replaced with a Dean-Stark tube, and then the toluene reflux was carried out until which dehydration was completed. Further, toluene was distilled off, to give a rubbery, white wax. The yield of the product was 96 g. The resulting wax is referred to as "WAX A."

The product was analyzed by GPC (GPC analyzer being manufactured by Waters Corporation, orthodichlorobenzene, 135° C., calibrated by standard samples of polyethylene). As a result, its weight-average molecular weight was found to be 18600, and a molecular weight distribution was 2.03. Also, the product was analyzed by $^1$H-NMR (NMR analyzer being manufactured by Bruker, 200 MHz, chloroform-d, 50° C., TMS being used as a standard). As a result, peaks assigned to following groups were observed:

–0.05 ppm (singlet): a methyl group bonded to a silyl group;

0.4 ppm (triplet): a methylene group bonded to a silyl group;

0.8 ppm (triplet): a methyl group at both ends of the main chain; and near 1.2 ppm: a methylene group of the main chain.

From the integral ratio of each peak, it was determined that the weight ratio of the polyethylene moiety to the siloxane moiety was 10:90.

Preparation Example 2 for Modified Polyethylene (WAX B)

The procedures similar to those of Preparation Example 1 were carried out except for changing the amount of octamethylcyclotetrasiloxane added in the step for carrying out equilibrium polymerization of the modified polyethylene and the cyclic siloxane in the presence of basic catalyst to 10 g, to give a white wax. The resulting wax is referred to as "WAX B."

The product was analyzed by GPC and $^1$H-NMR in the same manner as in Preparation Example 1. As a result, its weight-average molecular weight was 2100, and the molecular weight distribution was 1.8. Also, from the integral ratio of each peak, it was determined that the weight ratio of the polyethylene moiety to the siloxane moiety was 51:49.

Preparation Example 3 for Modified Polysiloxane (WAX C)

The procedures similar to those of Preparation Example 1 were carried out except for changing the amount of the terminus silanol-modified polyethylene to 1.2 g and the amount of octamethylcyclotetrasiloxane to 99 g, both of which were added in the step for carrying out equilibrium polymerization of the modified polyethylene and the cyclic siloxane in the presence of basic catalyst, to give a white wax. The resulting wax is referred to as "WAX C."

The product was analyzed by GPC and $^1$H-NMR in the same manner as in Preparation Example 1. As a result, its weight-average molecular weight was 175200, and the molecular weight distribution was 2.7. Also, from the integral ratio of each peak, it was determined that the weight ratio of the polyethylene moiety to the siloxane moiety was 2:98.

Preparation Example 1 for RESIN A 367.5 g of propylene oxide adduct of bisphenol A, 146.4 g of ethylene oxide adduct of bisphenol A, 126.0 g of terephthalic acid, 40.2 g of dodecenylsuccinic anhydride, and 77.7 g of trimellitic anhydride were placed in a two-liter separable flask together with stannous oxide used as a catalyst. The flask was equipped with a thermometer, a stainless stirring rod, a reflux condenser, and a nitrogen inlet tube, and the components were allowed to react at 220° C. under a nitrogen gas stream. The resulting resin is referred to as "RESIN A."

Preparation Example 2 for RESIN B

The same components used in Preparation Example 1 for RESIN A were allowed to react in a method similar to that of Preparation Example 1 except for changing the amount of propylene oxide adduct of bisphenol A to 126.0 g, the amount of ethylene oxide adduct of bisphenol A to 162.5 g, the amount of terephthalic acid to 83.0 g, the amount of dodecenylsuccinic anhydride to 53.6 g, and the amount of trimellitic anhydride to 38.4 g. The resulting resin is referred to as "RESIN B."

Preparation Example for RESIN C

In a four-necked glass flask equipped with a stainless stirring rod, a reflux condenser, a thermometer, and a nitrogen inlet tube, 400 g of toluene was placed. After heating the contents to 90° C., a liquid mixture comprising 1000 g of styrene monomers, 200 g of butyl acrylate, and 30 g of azobisisobutyronitrile was added dropwise to the flask under a nitrogen gas atmosphere while stirring the contents. The mixture was heated and stirred at 100° C. for 4 hours. Thereafter, the temperature was lowered again to 90° C., and a liquid mixture comprising 1000 g of styrene monomers, 200 g of butyl acrylate, and 6 g of azobisisobutyronitrile was added dropwise while stirring in a period of 2 hours. Further, the temperature of the reaction mixture was gradually raised to distill off toluene, and subsequently toluene was further removed under a reduced pressure, to give a transparent resin. The resulting resin is referred to as "RESIN C."

Example 1

138.0 g of styrene, 62.0 g of 2-ethylhexyl acrylate, 2.0 g of divinylbenzene, 12.0 g of carbon black "#44" (manufactured by Mitsubishi Kasei Corporation), 2.0 g of a charge control agent "T-77" (manufactured by Hodogaya Chemical Co., Ltd.), 20 g of RESIN A, 8.0 g of WAX A, and 6.0 g of 2,2'-azobisisobutyronitrile were added. The obtained mixture was introduced into an attritor ("Model MA-01SC," manufactured by Mitsui Miike Kakoki) and dispersed at 10° C. for 5 hours to give a polymerizable composition.

Next, the resulting polymerizable composition was added to 550 g of a 4% by weight aqueous colloidal solution of tricalcium phosphate which was previously prepared in a two-liter separable glass flask. The obtained mixture was dispersed with "T.K. HOMO MIXER, Model M" (manufactured by Tokushu Kika Kogyo) at a temperature of 15° C. and a rotational speed of 12000 rpm for 5 minutes.

Next, a four-necked glass cap was set on the flask, and a thermometer, a stainless steel stirring rod, a reflux condenser, and a nitrogen inlet tube were attached thereto. The flask was placed in an electric mantle heater. Thereafter, the contents were allowed to react with one another at 85° C. for 10 hours in a nitrogen gas stream while stirring. After the reaction product was cooled, the dispersing agent was dissolved in 10% by weight-aqueous hydrochloric acid. The resulting product was filtered, and the obtained solid was washed with water, subsequently dried under a reduced pressure of 20 mmHg at 35° C. for 24 hours, and then classified with an air classifier to give an encapsulated toner with an average particle size of 8 μm.

To 100 g of this encapsulated toner, 0.4 g of hydrophobic silica fine powder "AEROZIL R-972" (manufactured by Nippon Aerozil Ltd.) were added and mixed to give an encapsulated toner according to the present invention. This toner is referred to as "Toner 1."

Example 2

The procedures similar to those of Example 1 were carried out except for changing WAX A to WAX B, and also changing the charge control agent from "T-77" to "AIZEN SPILON BLACK TRH" (manufactured by Hodogaya Chemical Co., Ltd.), to give an encapsulated toner according to the present invention. This toner is referred to as "Toner 2."

Example 3

The procedures similar to those of Example 1 were carried out except for changing WAX A to WAX C, to give an encapsulated toner according to the present invention. This toner is referred to as "Toner 3."

Comparative Example 1

The procedures similar to those of Example 1 were carried out except for changing WAX A to a silicone oil "KF96-1000" (manufactured by Shin-Etsu Chemical Co., Ltd.; dimethylsiloxane structure; kinematic viscosity 1000 cSt: oily state at ambient temperature), to give a comparative toner. This toner is referred to as "Comparative Toner 1."

Comparative Example 2

The procedures similar to those of Example 1 were carried out except for changing WAX A to a polyethylene wax ("MITSUI HIWAX HW-800P," manufactured by Mitsui Petrochemical Industries, Ltd.), to give a comparative toner. This toner is referred to as "Comparative Toner 2."

Example 4

40 g of carbon black "MOGUL-L" (Cabot Corporation), 5.0 g of a charge control agent "BONTRON S-34" (manufactured by Orient Chemical Co., Ltd.), and 15 g of WAX B were added to 500 g of RESIN B. The resulting mixture was melt-kneaded, finely pulverized, and classified, to give a toner having an average particle size of 8 μm. Further, to 100 g of the resulting toner, 0.5 g of hydrophobic silica fine powder "AEROZIL R-972" (manufactured by Nippon Aerozil Ltd.) were added and mixed, to give a toner of the present invention. This toner is referred to as "Toner 4."

Example 5

The procedures similar to those of Example 4 were carried out except for changing RESIN B to RESIN C, to give a toner of the present invention. This toner is referred to as "Toner 5."

Comparative Example 3

The procedures similar to those of Example 4 were carried out except for changing WAX B to WAX C, to give a comparative toner. This toner is referred to as "Comparative Toner 3."

Comparative Example 4

The procedures similar to those of Example 4 were carried out except for changing WAX A to a silicone oil "KF96-1000" (manufactured by Shin-Etsu Chemical Co., Ltd.; dimethylsiloxane structure; kinematic viscosity 1000 cSt; oily state at ambient temperature), to give a comparative toner. This toner is referred to as "Comparative Toner 4."

Comparative Example 5

The procedures similar to those of Example 4 were carried out except for changing WAX A to a polyethylene wax ("MITSUI HIWAX HW-800P," manufactured by Mitsui Petrochemical Industries, Ltd.), to give a comparative toner. This toner is referred to as "Comparative Toner 5."

Test Example

Each of the developers was prepared by placing 6 parts by weight of each of the toners obtained in Examples and Comparative Examples and 94 parts by weight of spherical ferrite powder coated with styrene-methyl methacrylate copolymer resin having a particle size of 250 mesh-pass and 400 mesh-on into a polyethylene container, and mixing the above components by rotation of the container on the roller at a rotational speed of 150 rpm for 20 minutes. The developer is evaluated with respect to the lowest fixing temperature, the non-offset region, the scratches remaining on solid portion, the blocking resistance, and the free flowability by the methods detailed below.

(1) Lowest Fixing Temperature

Each of the developers prepared as described above is loaded on a commercially available electrophotographic copy machine to develop images. The copy machine is equipped with a selene-arsenic photoconductor and a fixing roller having a rotational speed of 255 mm/sec. The fixing device has variable heat-and-pressure, and an oil applying device is removed from the copying machine. By controlling the fixing temperature from 100° C. to 220° C., the fixing ability of the formed images are evaluated. The results are shown in Table 1.

The lowest fixing temperature used herein is the temperature of the fixing roller at which the fixing ratio of the toner exceeds 70%. This fixing ratio of the toner is determined by placing a load of 500 g on a sand-containing rubber eraser (LION No. 502) having a bottom area of 15 mm×7.5 mm which contacted the fixed toner image, placing the loaded eraser on a fixed toner image obtained in the fixing device, moving the loaded eraser on the image backward and forward five times, measuring the optical reflective density of the eraser-treated image with a reflective densitometer manufactured by Macbeth Process Measurements Co., and then calculating the fixing ratio from this density value and a density value before the eraser treatment using the following equation.

$$\text{Fixing ratio} = \frac{\text{Image density after eraser treatment}}{\text{Image density before eraser treatment}} \times 100$$

(2) Non-Offset Region

The offset resistance is evaluated by measuring the temperature of the low-temperature offset disappearance and the temperature of the high-temperature offset initiation. Specifically, copy tests are carried out by raising the temperature of the heat roller surface at an increment of 5° C. in the range from 70° C. to 240° C., and at each temperature, the adhesion of the toner onto the heat roller surface for fixing is evaluated by gross examination. The results are shown in Table 1.

(3) Scratches Remaining on Solid Portion of Formed Images

The scratches remaining on the solid portion of the formed images largely affected by releasing properties is evaluated by a fixing test using a commercially available electrophotographic copy machine equipped with a selene-arsenic photoconductor and a fixing roller having a rotational speed of 255 mm/sec, and observing the solid portion of the chart after fixing. Here, the evaluation is made by the following ranks:

o: No scratches remained in the entire temperature ranges.

Δ: Scratches remained in a part of the temperature ranges.

x: Scratches remained in the entire temperature ranges.

The results are shown in Table 1.

(4) Blocking Resistance

The blocking resistance is determined by keeping the toner standing for 24 hours under the conditions at a temperature of 50° C. and a relative humidity of 40%, and evaluating the extent of the generation of agglomeration. Here, the evaluation is made in the following ranks:

o: Powdery state is maintained;

Δ: Some lumps are present but easily broken by pressing with a finger; and x: Large lumps are present and does not regain its original powder form.

The results are shown in Table 1.

(5) Free Flowability

The free flowability is evaluated by the weight of the toners on a sieve when sieving with a 150 mesh-opening sieve. Here, the evaluation is made in the following ranks:

Good: Amount remaining on the sieve is less than 2% by weight;

Slightly Poor: Amount remaining is 2% by weight or more and less than 5% by weight; and Poor: Amount remaining is 5% by weight or more.

TABLE 1

| | Lowest Fixing Temp. (°C.) | Non-Offset Region (°C.) | Scratches on Solid Portion | Blocking Resistance | Free Flowability |
|---|---|---|---|---|---|
| Toner 1 | 95 | 80–220 | ○ | ○ | Good |
| Toner 2 | 100 | 85–240 | ○ | ○ | Good |
| Toner 3 | 95 | 80–220 | ○ | ○ | Good |
| Comparative Toner 1 | 95 | 85–200 | Δ | × | Poor |
| Comparative Toner 2 | 120 | 120–240 | × | ○ | Good |
| Toner 4 | 150 | 120–240 | ○ | ○ | Good |
| Toner 5 | 170 | 125–240 | ○ | ○ | Good |
| Comparative Toner 3 | 140 | 120–240 | ○ | Δ | Slightly Poor |
| Comparative Toner 4 | 150 | 125–240 | Δ | × | Poor |
| Comparative Toner 5 | 170 | 140–240 | × | ○ | Good |

When Toners 1 to 3 and Comparative Toners 1 and 2 in Table 1 are compared, the following observation can be made. The toners of the present invention shows notable improvements in the scratches remaining on the solid portion, the blocking resistance, and the free flowability while maintaining good low-temperature fixing ability and enjoying wide non-offset regions. By contrast, in a case of Comparative Toner 1 where a pulverized toner contains a silicone oil in an oily state, the blocking resistance and the free flowability are particularly poor. In a case of Comparative Example 2 where a toner contains a polyethylene wax, there are problems in the low-temperature fixing ability and the scratches remaining on the solid portion.

Also, when Toners 4 and 5 and Comparative Toners 3 to 5 in Table 1 are compared, the following observation can be made. The toners of the present invention shows notable improvements in the scratches remaining on the solid portion, the blocking resistance, and the free flowability while maintaining good low-temperature fixing ability and enjoying wide non-offset regions. By contrast, in a case of Comparative Toner 3 where a toner contains a modified polysiloxane having a low weight proportion of the saturated hydrocarbon group moiety, the blocking resistance and the free flowability are slightly poor. In a case of Comparative Toner 4 where a toner contains a silicone oil in an oily state, the blocking resistance and the free flowability are particularly poor. In a case of Comparative Example 5 where a toner contains a polyethylene wax, there are problems in the low-temperature fixing ability and the scratches remaining on the solid portion.

The present invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A toner for developing an electrostatic latent image comprising a binder resin, a colorant, and a modified polysiloxane having the general formula (1):

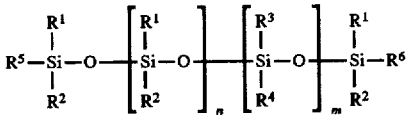

(1)

wherein $R^1$ to $R^4$, which may be identical or different, each stands for an alkyl group having 1 to 6 carbon atoms, a phenyl group, or a naphthyl group; $R^5$ and $R^6$, which may be identical or different, each stands for a linear or branched, saturated hydrocarbon group having an average number of carbon atoms of from 16 to 600; and n and m each stands for a number of zero (0) or more.

2. The toner for developing an electrostatic latent image according to claim 1, wherein $R^5$ and $R^6$ in the general formula (1), which may be identical or different, each stands for a linear or branched, saturated hydrocarbon group having an average number of carbon atoms of from 40 to 300.

3. The toner for developing an electrostatic latent image according to claim 1, wherein a sum of n and m in said General formula (1) is from 20 to 1000.

4. The toner for developing an electrostatic latent image according to claim 1, wherein the modified polysiloxane has a weight ratio of a total amount of the saturated hydrocarbon group moiety at both ends thereof to the polysiloxane moiety of from 10/90 to 80/20.

5. The toner for developing an electrostatic latent image according to claim 1, wherein said toner is produced by pulverization method.

6. The toner for developing an electrostatic latent image according to claim 1, wherein the amount of the modified polysiloxane added to the toner is 1.0 to 10 parts by weight, based on 100 parts by weight of the binder resin.

7. The toner for developing an electrostatic latent image according to claim 1, wherein said toner is an encapsulated toner for heat-and-pressure fixing comprising a heat-fusible core material comprising at least a thermoplastic resin and a colorant, and a shell formed thereon so as to cover the surface of the core material.

8. The toner for developing an electrostatic latent image according to claim 7, wherein a main component of the shell is an amorphous polyester.

9. The toner for developing an electrostatic latent image according to claim 7, wherein said toner is produced by in situ polymerization method.

* * * * *